United States Patent [19]

Lang et al.

[11] 4,060,946

[45] Dec. 6, 1977

[54] IN-GROUND SWIMMING POOL CONSTRUCTION

[75] Inventors: Robert S. Lang, Tampa; Rodney Morris Post, Largo; Thomas Leo Hogan, Tampa, all of Fla.

[73] Assignee: L. F. Lang & Son Pools, Inc., Tampa, Fla.

[21] Appl. No.: 687,537

[22] Filed: May 18, 1976

[51] Int. Cl.[2] ..... E04H 3/18

[52] U.S. Cl. ..... 52/169.7; 52/225; 52/226; 52/742; 249/DIG. 3

[58] Field of Search ..... 61/39, 53.68; 52/23, 52/166, 149, 150, 151, 169, 157, 152, 146, 742, 225, 226; 4/172, 172.19, 172.21; 249/18, 19, DIG. 3, 210; 264/31, 34, 35

[56] References Cited

U.S. PATENT DOCUMENTS

| | | | |
|---|---|---|---|
| 1,231,426 | 6/1917 | Ravier | 61/39 |
| 2,300,375 | 10/1942 | Turner | 52/150 |
| 2,887,759 | 5/1959 | Brownell, Jr. | 52/742 |
| 3,015,191 | 1/1962 | Lucchesi | 52/169 |
| 3,020,560 | 2/1962 | Bedick | 4/172.19 |
| 3,031,801 | 5/1962 | Leuthesser | 4/172.19 X |
| 3,295,274 | 1/1967 | Fulton | 52/157 |
| 3,317,925 | 5/1967 | Vance | 4/172 |
| 3,355,897 | 12/1967 | Mullen, Jr. | 249/DIG. 3 |
| 3,444,659 | 5/1969 | Shanni | 52/149 |
| 3,511,002 | 5/1970 | Fox | 52/146 |
| 3,551,920 | 1/1971 | Greene | 4/172.19 |
| 3,564,791 | 2/1971 | Arp | 52/169.7 |
| 3,659,295 | 5/1972 | Lineaker | 4/172.19 |
| 3,739,588 | 6/1973 | Schroter et al. | 61/39 X |
| 3,748,810 | 7/1973 | Mattingly | 52/742 |
| 3,798,857 | 3/1974 | Banera | 52/169 |
| 3,823,690 | 7/1974 | Rynberk | 52/169 X |
| 3,841,041 | 10/1974 | Friedland | 4/172 X |
| 3,848,367 | 11/1974 | Barnes | 52/157 |
| 3,871,142 | 3/1975 | Abbott | 52/157 X |
| 3,906,688 | 9/1975 | Witte | 52/152 |

*Primary Examiner*—Leslie Braun
*Attorney, Agent, or Firm*—Oltman and Flynn

[57] ABSTRACT

Ground anchors are used to reinforce an in-ground swimming pool shell, which may have sectional walls fastened to a concrete bottom or may be a one-piece shell.

3 Claims, 11 Drawing Figures

A
S
E
L

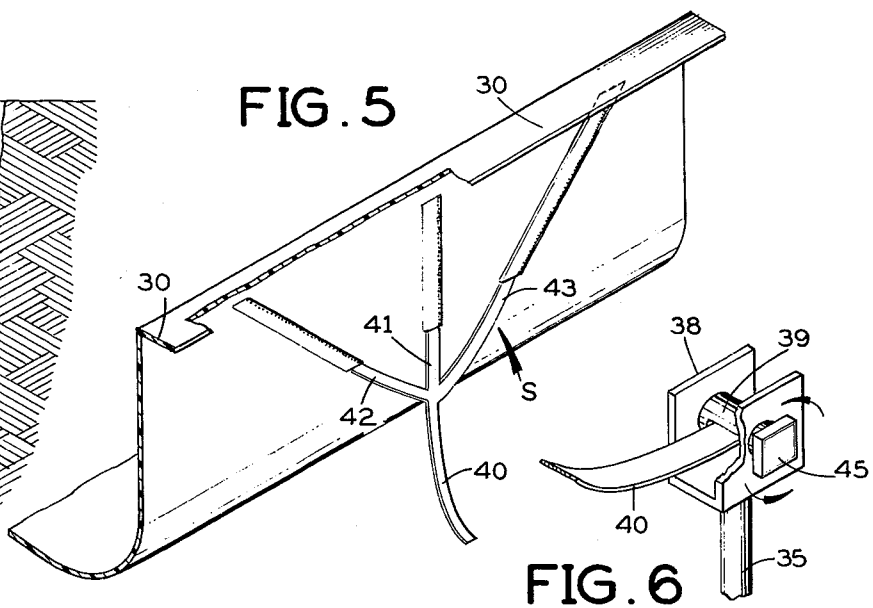
FIG. 5
FIG. 6
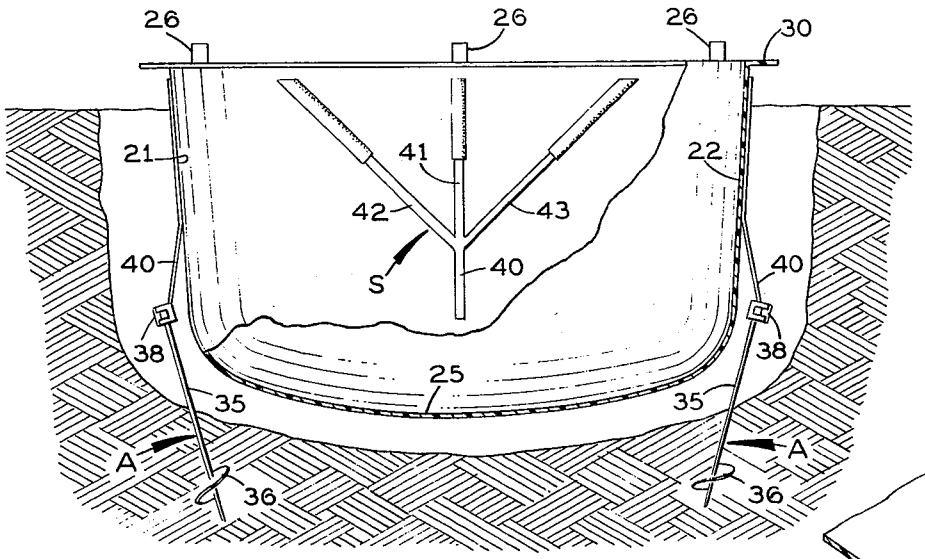
FIG. 4
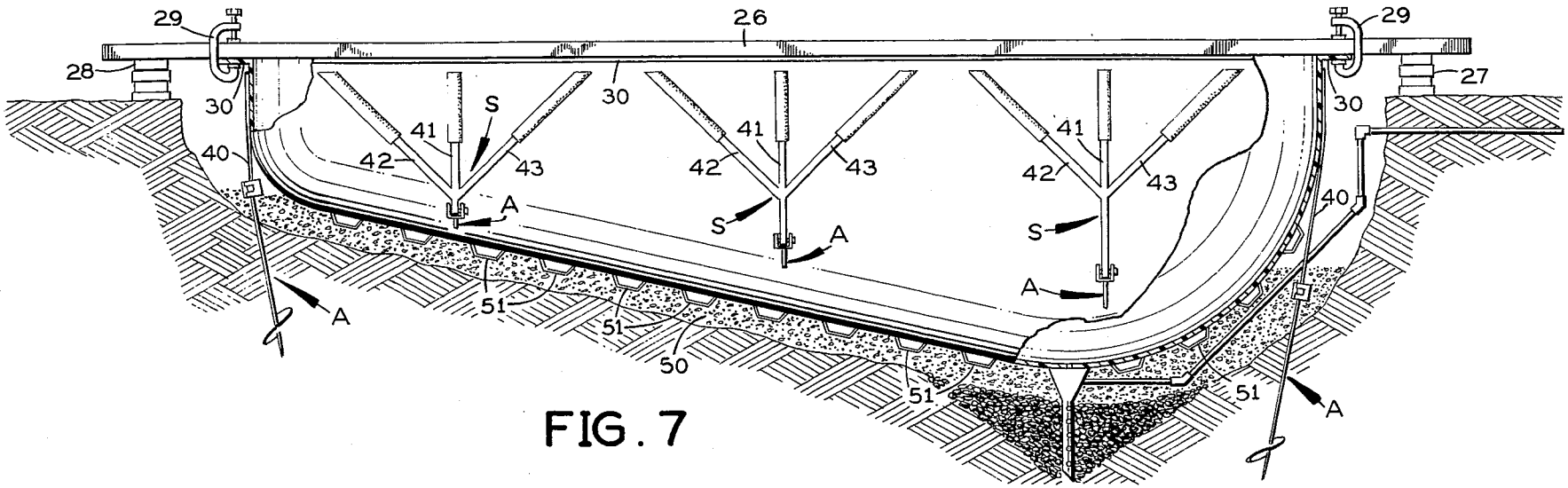
FIG. 7

IN-GROUND SWIMMING POOL CONSTRUCTION

BACKGROUND OF THE INVENTION

In-ground swimming pools made of glass fiber-reinforced plastic ("fiberglass") or similar light weight materials have been used since at least as early as the late 1950s. The earliest pools of this general type were manufactured in sections which were mechanically fastened and chemically cemented together in the field. Later, sometime in the 1960s, another type of fiberglass pool came into use which consisted of a number of small, modular, fiberglass panels which were bolted together with the use of gaskets to achieve a waterproof shell. Presently, the most popular fiberglass pools in use are either of one-piece construction or have two or more large sections bolted together and gasketed and assembled on the site. Large pools are sectionalized because of the difficulty of transporting fiberglass shells larger than about 12 feet by 28 feet over the highways.

Fiberglass or other light weight swimming pools have not received widespread popular acceptance, and fiberglass pools which have been installed have suffered a high incidence of failure after or during installation. One reason for these failures is the tendency of such pools to float in the earth excavation as a consequence of hydrostatic pressure from ground water or surface water outside the pool shell. The dead weight of a fiberglass pool shell is exceedingly light compared to pool shells made of concrete, steel or other popular swimming pool materials. This increases the danger of floating the shell during construction or whenever it might be drained for servicing at a later date.

A swimming pool presents a unique construction hazard any time that ground water (water table) or rain water flowing into the excavation reaches a point on the outside of the shell at which the weight of the water displaced by the pool equals the dead weight of the pool shell. The shell is then subject to floating. This is a serious problem during construction. It is not at all unusual to float pools before they are completed and filled with water. When this occurs, the pool shell must be removed from the excavation, the excavation must be drained and reshaped, and the pool shell reinstalled.

In the case of fiberglass pool shell constructions, most designers depend on the weight of the concrete deck or walkway around the pool to keep it from floating in the event that the pool must be drained after completion, the concrete walkway acting as ballast to oppose hydrostatic uplift. This is unsatisfactory. First, the walkway usually does not provide enough dead weight to keep the empty pool shell static. Second, few if any fiberglass pool shells have enough structural integrity to withstand inverse loading to this degree without "oil canning" or "buckling", which results in damage to the pool shell.

The installation of pool shells of prefabricated sectional construction, whether the pool sections are of fiberglass or of other suitable material, has presented certain problems. Prior to the present invention, the usual practice has been to support the walls of the sectionalized pool shells during and after installation by A frames, X frames, or tie-backs to concrete "deadmen" embedded in the ground. Such supports have limited capacity to withstand loading on the pool shell, particularly during backfilling with conventional backfill material, such as sand and water, stabilized soil, cement, or small rock. During such backfilling, the pool walls cannot be maintained vertical by the previously used support arrangements unless the backfill material is introduced very carefully and no hydraulic puddling or mechanical compaction is done to the backfill material.

Most prior bracing systems for sectionalized pools also require that concrete be poured at the base of the walls encasing the lower elements of the bracing system and the bottom of the walls. Use of this technique causes a delay of at least one day in construction time while the concrete takes its initial cure. Periodic shortages of concrete, delivery delays and scheduling problems also compound production delays.

Because the backfill material cannot be adequately compacted when conventional bracing systems are used, decks and walkways around the pool may settle and crack as the backfill material under the deck settles and consolidates after the pool is completed. This is not only unslightly but frequently causes damage to the pool walls when such settling occurs.

The previously used bracing systems for sectionalized pools are made up of many parts and require a multiplicity of hardware and fastening devices which require a great deal of work time in the field to assemble and to attach to the walls. Furthermore, until the concrete encasement around the outside of the walls has been poured and has taken its initial set, these bracing systems require temporary bracing and constant adjustment and re-adjustment to hold the walls in place.

SUMMARY OF THE INVENTION

The present invention is directed to a novel in-ground swimming pool construction which overcomes the foregoing difficulties and disadvantages.

In accordance with this invention, auger-type ground anchors are connected to the pool shell to reinforce it, both during and after backfilling, against displacement by the backfill material or hydrostatic pressure in the adjacent ground. Such ground anchors are particularly advantageous for use with swimming pool shells constructed of two or more wall sections, whether of fiberglass or other suitable material, as well as with one-piece fiberglass pool shells.

These anchors are simple to install and in the case of sectionalized pools they obviate the need for concrete as part of the wall-bracing structure. Consequently, these ground anchors enable the reduction of one or more work days in the installation of such pools. Also, these ground anchors enable the builder to compact the backfill material as much as he considers necessary to avoid later settling of the pool decks, which would damage the pool walls. Also, they make it possible for the sectional pool wall to be adjusted in and out and held securely in a vertical position to withstand all kinds of loads.

A principal object of this invention is to provide a novel and improved in-ground swimming pool construction having auger-type ground anchors reinforcing the pool shell against external forces, such as from backfilling or from hydrostatic uplift pressure from ground or surface water.

Another object of this invention is to provide a novel sectionalized, in-ground swimming pool construction having such ground anchors.

Yet another object of this invention is to provide a one-piece, lightweight, in-ground swimming pool having such ground anchors.

Another principal object of this invention is to provide a novel and improved method of constructing an in-ground swimming pool.

Another object of this invention is to provide a novel and improved method of constructing an in-ground swimming pool which involves the use of ground anchors of proven performance characteristics to reinforce the pool shell during and after backfilling.

Another object of this invention is to provide a novel and improved method of installing an in-ground pool with sectionalized walls.

Another object of this invention is to provide a novel and improved method of installing an in-ground, one-piece light weight pool.

Further objects and advantages of this invention will be apparent from the following detailed description of three presently-preferred embodiments thereof, which are shown in the accompanying drawings, in which:

FIG. 4 is a vertical cross-section taken along the line 4—4 in FIG. 1;

FIG. 5 is a fragmentary perspective view showing one set of tensioning straps for attaching the one-piece pool shell to a corresponding ground anchor;

FIG. 6 shows a typical adjustable tensioning device between one of these sets of straps and the corresponding ground anchor;

FIG. 7 is a view similar to FIG. 2 after the fill has been backfilled beneath and around the pool in the earth excavation, and showing a slightly modified pool shell having external reinforcements;

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

Figures 1, 2, 3:
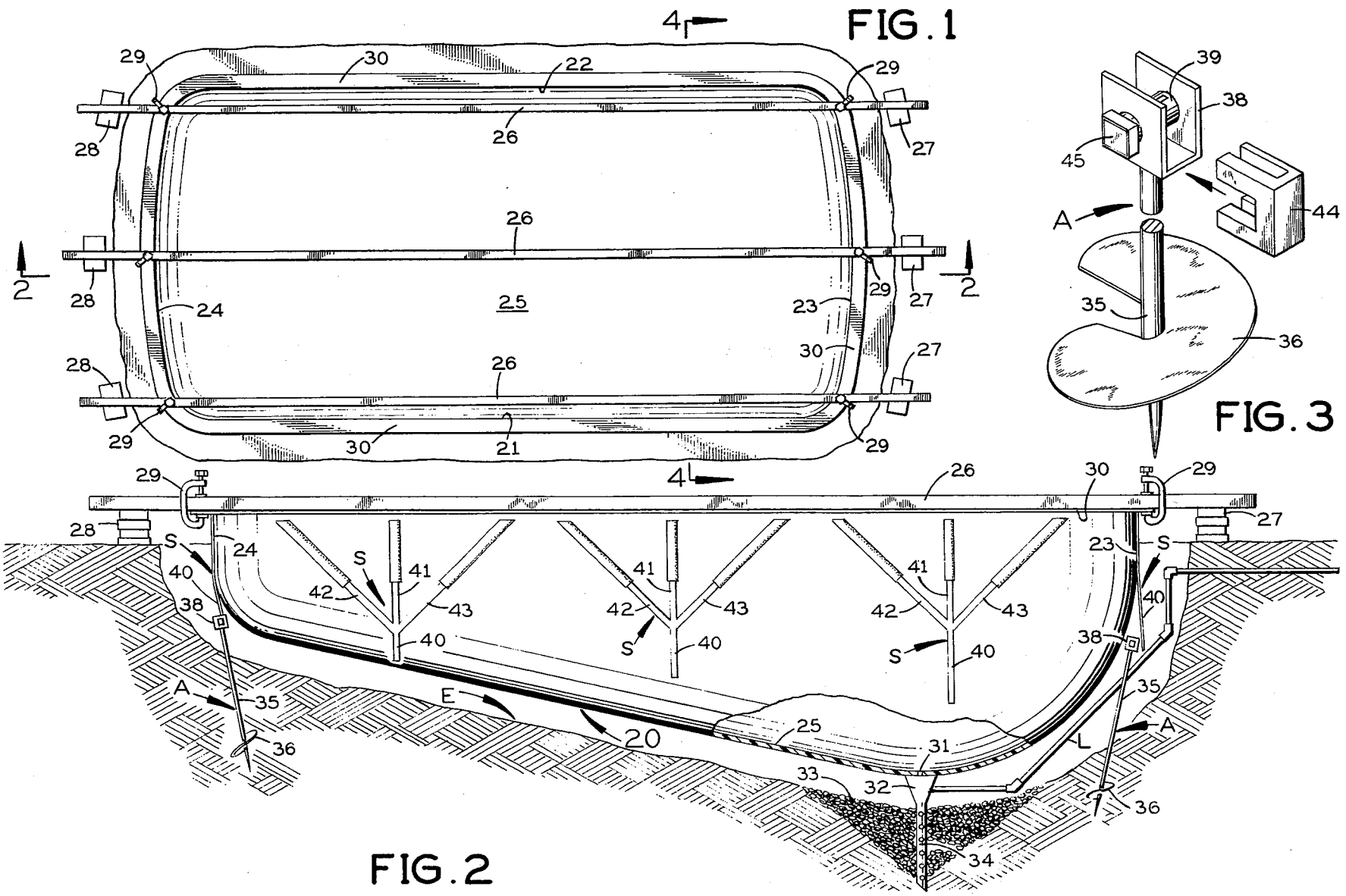
FIG. 1 is a top plan view of a one-piece swimming pool during its construction in accordance with the present invention.
FIG. 2 is a vertical section taken along the longitudinal centerline of this pool at 2—2 in FIG. 1.
FIG. 3 is an exploded perspective view of one of the ground anchors used in this pool construction.

As shown in FIG. 2, the fiberglass pool shell 20 is of one-piece construction with smoothly interconnected, upstanding sides 21, 22, 23 and 24 (FIG. 1) running along its length and transversely across each end, respectively, and a sloping, generally flat bottom 25. A similarly shaped but slightly larger excavation E is dug in the earth to receive the pool shell, as shown in FIG. 2. This excavation need not conform closely to the external configuration of the pool shell 20 but instead there may be a space of several inches between the bottom and sides of the pool shell and the earth at the excavation.

As shown in FIGS. 1 and 2, the pool shell 20 is suspended in the excavation E by means of several elongated beams 26 which rest on support blocks 27, 28 extending up from the ground at the opposite ends of the excavation E. These support beams extend horizontally lengthwise over the top of the pool shell, and C-clamps 29 engage beneath a peripheral horizontal flange 30 (FIG. 2) on the pool shell to hold it up tight against the corresponding support beam 26.

As shown in FIG. 2, the pool shell has a drain opening 31 at the low point in its bottom wall which is connected through a return line L to a water recirculating system for the pool.

A hydrostat 32 below this drain opening picks up water that is leached from the ground by a dewatering sump 33. Ground water then may be removed by pumping up through the drain 34 and away to waste.

In accordance with one important aspect of the present invention, auger-type ground anchors A of known design are screwed into the ground at the excavation E before the pool shell is lowered into the position shown in FIG. 2. Referring to FIG. 3, each of these ground anchors has an elongated, rigid, rod-like central stem 35 with a pointed lower end and one or more spiral-shaped anchoring plates or "flytes" 36 attached to the stem to prevent the anchor from being pulled out of the ground. Ground anchors of this general type have been used by electric utilities and are rated as withstanding pulls in excess of 10,000 pounds per anchor in sandy soils with an anchor penetration into the ground of as little as 30 inches.

As shown in FIG. 2, at each end of the ground excavation E a single ground anchor A extends down into the ground almost vertically but with a slight downward and inward inclination in a direction lengthwise of the excavation. It is to be understood that more than one ground anchor may be provided at each end.

In addition to the end anchors, at each longitudinal side of the excavation E there are a suitable number of additional ground anchors A, such as three, embedded in the ground below and spaced apart more or less equidistantly, as shown in FIG. 7. As shown in FIG. 4, these ground anchors at the sides of the excavation extend down into the ground almost vertically but with a slight downward and inward inclination.

As shown in FIG. 3, each ground anchor A has a generally U-shaped clevis 38 on its upper end with a slotted cross pin 39 that may be rotated to adjust the tension on a flexible metal fastener strap 40 (FIG. 5) extending down through its slot. Other fastening techniques may be used, if desired.

Strap 40 is on the lower end of a unitary strap assembly S (FIG. 5) whose upper ends are joined rigidly and permanently to the adjacent wall of the pool shell 20. In the particular embodiment shown, the lower strap 40 is joined to a central upper strap 41 and diagonally outwardly inclined upper straps 42 and 43 on each side. Each of the upper straps 41, 42, 43 in the unitary strap assembly S is embedded in and bonded to the adjacent wall of the pool shell 20 during lay-up of the successive laminations of this shell so as to be permanently joined to this wall.

Preferably, each ground anchor and its tension strap are made of stainless steel, hot-dipped galvanized steel, or other suitable non-corrodible material that is able to withstand chemicals or moisture in the ground.

Figures 8, 9, 10, 11:
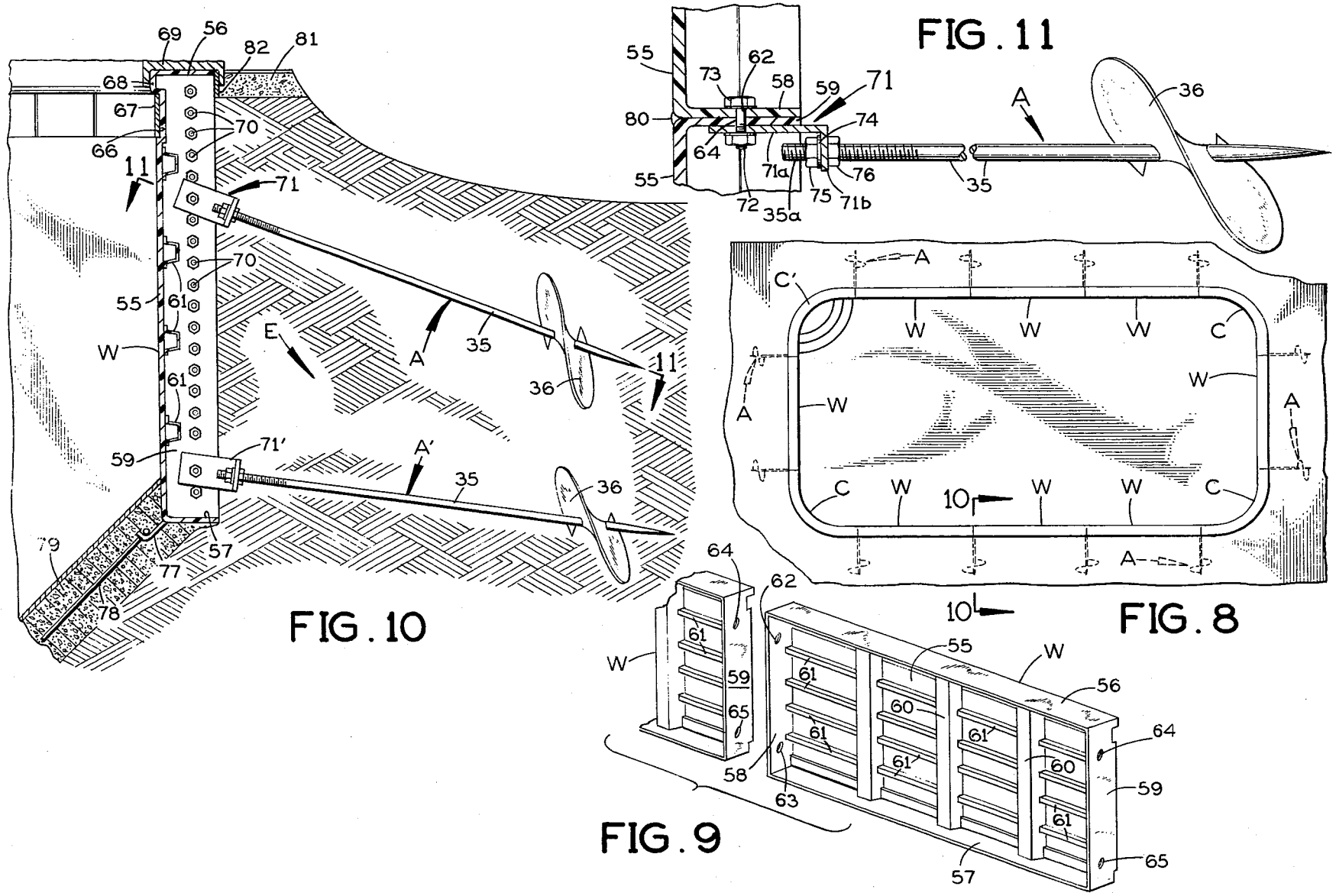
FIG. 8 is a top plan view of a sectionalized pool having ground anchors in accordance with the presently-preferred embodiment of this invention.
FIG. 9 is a fragmentary perspective view showing one of the straight wall sections of the FIG. 8 pool and part of the next wall section.
FIG. 10 is a vertical section taken along the line 10—10 in FIG. 8 and showing two ground anchors at the juncture between two adjoining wall sections of the pool.
FIG. 11 is a view taken along the line 11—11 in FIG. 10, showing the upper ground anchor in elevation and its connection to the pool wall in section.

The lower end of the strap 40 is inserted into the slot in the cross pin 39 and the latter is turned to a position establishing the desired tension on this strap, after which a generally U-shaped, bifurcated locking device 44 (FIG. 3) may be slipped over one end of the clevis to snugly engage the polygonal head 45 on the outer end of cross pin 39, as shown in FIG. 8, thereby locking the slotted cross pin 39 against rotation and maintaining the tension on the strap 40.

With this tension adjustment having been provided at each of the ground anchors A, these anchors all tend to pull the pool shell 20 down into the excavation E. At this time, this downward tension is resisted by the support beams 26, which maintain the pool shell in a level position suspended above the bottom of the excavation.

With the various parts of the pool assembly in this position, the space beneath and around the pool shell 20 in the ground excavation E is backfilled with a suitable fill material 50, such as sand and water, or cement. Preferably, this is done by inserting a tube under the bottom of the pool shell and feeding the fill through this tube to be discharged into the space beneath the pool shell.

After filling in the space beneath the pool shell, backfill material is discharged into the space around the sides of the pool shell.

From the foregoing it will be apparent that after the support beams 26 and C-clamps 29 are removed, the pool shell 20 will rest in the rigid support bed provided by the solidified fill. The straps S and ground anchors A will be in tension and the solidified fill will be in compression.

The ground anchors A prevent the pool shell from being lifted up as a result of hydrostatic pressure from ground water or surface water, or as a result of a settling or shifting of the ground after the pool is installed.

FIG. 7 illustrates a slightly modified arrangement of the one-piece pool shell in which reinforcing pieces 51 extend across the outside of the pool shell from side to side on the bottom. In other respects, this pool and its installation are essentially identical to the one described in detail with reference to FIGS. 1–6.

FIGS. 8–11 illustrate the presently-preferred embodiment of this invention, in which the pool is of sectionalized wall construction with ground anchors attached to it to overcome the difficulties previously encountered with such sectionalized, in-ground pools.

Referring to FIG. 8, the pool wall may comprise three straight wall sections W on each side connected end-to-end, one similar straight wall section W at each end, and corner sections C connecting the sides to the ends at three corners of the pool, and a special corner section C′ with steps at the fourth corner of the pool. The straight wall sections W may be 8 feet long and 4 feet high, for example.

As shown in FIG. 9, each straight wall section W comprises a substantially flat, vertical inner panel 55, horizontal, outwardly projecting flanges 56 and 57 at the top and bottom, and vertical, outwardly projecting flanges 58 and 59 at the opposite ends. Three vertical stiffeners or ribs 60 are bonded to the outside of the inner panel 55 at evenly spaced intervals. Four horizontal stiffeners or ribs 61 are bonded to the outside of the inner panel 55 at even intervals from top to bottom. The entire wall section is of glass fiber-reinforced plastic ("fiberglass") with the various parts joined to each other into a single, integral structure of substantial rigidity and strength.

The left end flange 58 of the wall section is formed with upper and lower openings 62 and 63, which register with similar upper and lower openings 64 and 65 formed in the right end flange 59 on the next wall section when the wall sections are juxtaposed with their respective end flanges abutting against one another.

As shown in FIG. 10, the vertical inner panel 55 of each wall is slightly offset near its upper end to provide a shallow, rectangular recess 66 for receiving tile 67. Above this recess the inner panel presents a slightly inwardly protruding lip 68 at the top, just below the horizontal top flange 56. A slab 69 of simulated brick covers the top of flange 56 and extends down in front of the lip 68 on the wall section.

In addition to the upper and lower paired openings 62, 64 and 63, 65 shown in FIG. 9, the end flanges of the wall sections are formed with evenly spaced bolt holes 70 (FIG. 10) which register with each other so that the abutting end flanges of adjoining sections can be bolted to each other.

Referring to FIGS. 10 and 11, at each matching pair of the upper openings 62 and 64, a generally L-shaped connecting plate 71 abuts against the inside of one of these flanges. Plate 71 has an opening 72 in its longer leg **71*a* which registers with the flange openings 62 and 64. These parts are bolted to each other by a bolt and nut assembly 73**.

The connecting plate 71 has a shorter leg **71*b*, which extends parallel to the inner panel 55 of the wall section at a location a short distance outward from the outer edges of the wall section flanges 58 and 59. This shorter leg 71*b* of the connecting plate has an opening through which the threaded end 35*a* of the stem or shank 35 of the ground anchor passes loosely. A washer 74 and a nut 75 are located at the inner side of leg 71*b*, and a nut 76 is located at its outer side. Both nuts are screw threaded onto the threaded section 35*a* of the ground anchor stem 35**, and they permit the wall sections to be adjusted in or out along this ground anchor shank.

FIG. 10 shows a typical placement of this upper ground anchor, extending laterally outward and down at a slight angle into the earth.

At the same abutting end flanges on the adjoining wall sections, a second ground anchor is attached in the same fashion through an L-shaped connector plate 71′, which is bolted to these end flanges of the wall sections at their lower openings 63 and 65, respectively, in the same fashion as shown in FIG. 11. As shown in FIG. 10, this lower anchor A′ extends laterally outward from the pool wall almost horizontally, making only a very slight angle downward.

Each wall section at its lower end has a plurality of J-shaped bars 77 extending downward and inward from its lower inside corner, as shown in FIG. 10. The J-bars are hooked under reinforcing bars 78, which are embedded in the upwardly-sloping concrete bottom 79 of the pool. These bars anchor the bottom of each wall section to the pool bottom. As shown in FIG. 10, the outer end of the bottom flange 57 on each wall section rests directly on the ground at the edge of the excavation.

It will be apparent that in constructing the sectional pool, after the lower ends of the wall sections have been anchored to the pool bottom, as shown in FIG. 10, the wall sections can be adjusted in or out along the respective upper and lower ground anchors to maintain the pool wall vertical, whatever loading occurs on it due to the backfill or ground or surface water.

At the junctures between neighboring wall sections the crack is filled with suitable caulking 80 (FIG. 11). A concrete deck 81 (FIG. 10) may be poured around the outside of the pool at the top, separated from the pool wall sections by a suitable expansion joint 82.

It is to be understood that the corner sections of the pool wall are essentially similar, except for their curvature, to the straight wall sections, and they are mounted in the same fashion as the latter. As shown in phantom in FIG. 8, ground anchors are provided at each junction between neighboring sections of the pool wall. There are upper and lower ground anchors at each such location, connected to the adjoining wall sections of the pool and embedded in the earth substantially as shown in FIG. 10.

If desired, the attachment of each ground anchor to the pool wall may be made through a turnbuckle by which the wall can be adjusted in or out without disturbing the positions of the anchors in the ground. Other equivalent adjustable connectors may be substituted, if desired.

It is to be understood that, in accordance with the present invention, the ground anchors may be used with sectionalized pool walls of steel or other heavy material, as well as with pool walls of light weight material, such as fiberglass.

In constructing a sectionalized pool according to this invention, after the earth excavation has been dug the ground anchors A and A' are embedded in the ground at the sides of the excavation, with the ends of the ground anchor stems 35 projecting into the excavation, as shown in FIG. 10. The reinforced concrete bottom of the pool is constructed at the bottom of the excavation and the pool wall sections are inserted down into the excavation around the periphery of the pool bottom. These pool wall sections rest directly on the ground around the bottom of the excavation, and at the inside their lower ends are anchored to the reinforcing rods 78 in the pool bottom by means of the J bars 77. The pool wall sections are connected to one another end-to-end and to the ground anchors, as described, so as to extend vertically. The excavation is backfilled around the outside of the pool walls. Any necessary adjustments of the pool wall sections in or out along the ground anchors may be made during or after backfilling for the purpose of keeping the pool wall vertical.

We claim:

1. In an in-ground swimming pool construction including a plastic swimming pool shell structure which is suspended from above in an earth excavation during construction and which rests on backfill in the final swimming pool construction, the shell having substantially rigid, preformed, plastic sides received in said excavation and spaced from the earth thereat, the improvement comprising:

a plurality of ground supported beams having means suspending said pool shell structure in said excavation from above said excavation;

a plurality of ground anchors embedded in the earth at said excavation and operatively connected to the sides of the pool shell structure in said excavation;

said ground anchors including tensioning means adjustable to pretension said shell from said beams before backfill is placed in said excavation and for tensioning said shell against said backfill after said backfill has been placed in said excavation;

said ground anchors comprising auger-type anchors each having an elongated, rod-like, rigid, central stem and a transverse anchor plate extending spirally around said stem for firmly anchoring said shell in the ground both during pre-backfill tensioning of said shell and during post-backfill tensioning of said shell.

2. A swimming pool construction according to claim 1 wherein said shell structure is a one-piece body of light weight plastic material providing a pool bottom and upstanding sides around the pool bottom, and said ground anchors extend down from the adjacent sides of the pool shell structure into the ground at the bottom of the excavation.

3. A swimming pool construction according to claim 2 wherein said tensioning means includes straps connecting said ground anchors under said tension to the adjacent sides of the pool shell structure, the straps being embedded at one end thereof in the plastic material of the shell structure, and a rotary tensioning member on which the other ends of said straps are wound.

* * * * *